US005947770A

United States Patent [19]

Shinchi

[11] Patent Number: 5,947,770

[45] Date of Patent: Sep. 7, 1999

[54] ELECTRIC WIRE CONNECTION STRUCTURE

[75] Inventor: Akira Shinchi, Shizuoka-ken, Japan

[73] Assignee: Yazaki Corporation, Tokyo, Japan

[21] Appl. No.: 08/996,423

[22] Filed: Dec. 22, 1997

[30] Foreign Application Priority Data

Dec. 24, 1996 [JP] Japan ..... 8-343642

[51] Int. Cl.[6] ..... H01R 9/03

[52] U.S. Cl. ..... 439/656; 156/73.1

[58] Field of Search ..... 439/656, 606, 439/874, 604, 466, 467; 156/73.1, 73.2, 73.4

[56] References Cited

U.S. PATENT DOCUMENTS 5,584,122 12/1996 Kato et al. ..... 29/872

5,641,307 6/1997 Gerrans ..... 439/606

FOREIGN PATENT DOCUMENTS 7-70345 7/1995 Japan .

*Primary Examiner*—Paula Bradley

*Assistant Examiner*—Antoine Ngandjui

*Attorney, Agent, or Firm*—Finnegan, Henderson, Farabow, Garrett & Dunner, L.L.P.

[57] ABSTRACT

A terminal is placed in a groove portion of a first member and, in a state where a covered electric wire is placed on the terminal, the resulting laminate is pressed by a second member. By applying ultrasonic vibrations while this pressing is being maintained as is, the first member and the second member are welded to each other. The second member is made of resin having a heat resistance lower than the resin constituting a block portion which forms a bottom wall portion of the groove portion. By performing the above pressing in a state where heat is being generated by application of ultrasonic vibration, it does not happen that the block portion supporting the terminal is recessed even when the second member is recessed. This eliminates the possibility that the terminal may be embedded in the resin.

2 Claims, 5 Drawing Sheets

ELECTRIC WIRE CONNECTION STRUCTURE

BACKGROUND OF THE INVENTION

1. Field of the Invention

The present invention relates to an electric wire connection structure in which a first member and a second member clamping an electric wire and a terminal therebetween are welded to each other by application thereto of ultrasonic vibration.

2. Description of Relevant Art

In Japanese Patent Publication No. 7-70345 there is described a method of welding to each other a first member and a second member clamping an electric wire and a terminal therebetween by application thereto of ultrasonic vibration.

FIGS. 1A and 1B show a connector which is manufactured by this conventional method and in which a first member and a second member each made of resin oppose each other.

In an upper surface of the first member there is formed a groove portion 3 in the longitudinal direction thereof and small concave portions 4 are formed at suitable intervals in the longitudinal direction of the groove portion 3. In the groove portion 3 of the first member 1 there is inserted in the longitudinal direction thereof a terminal 5 on which a covered electric wire 6 is placed. The covered electric wire 6 is placed on the terminal 5 in a state where a number of core wires are covered by an insulating covering.

On an underside of the second member 2 there is formed a protruding portion 7 which is to be fitted into the groove portion 3 of the first member 1 and there are formed small convex portions 8 which are to be fitted into the concave portions 4 of the groove portion 3.

When assembling this structure, the protruding portion 7 of the second member 2 is fitted into the groove portion 3 of the first member 1 in a state where the terminal 5 and the covered electric wire 6 are inserted into the groove portion 3, after which the terminal 5 and the covered electric wire 6 are pressed by the second member 2 and the first member 1. At this time, the terminal 5 and the covered electric wire 6 are partially bent at the portions wherein the concave portions 4 and the convex portions 8 are interfitted with each other, to thereby prevent draw-off of the terminal 5 and the covered electric wire 6.

And, ultrasonic vibration is applied from a horn (not shown) with the first member 1 and the second member 2 being clamped thereby. Due to the heat generated by application of ultrasonic vibration, an insulating covering of the covered electric wire 6 is molten and removed with the result that a core wire of the covered electric wire 6 and the terminal 5 are contacted with each other and brought into electric conduction therebetween. Simultaneously with this electric conduction, due to the heat resulting from the application of ultrasonic vibration the first member 1 and the second member 2 are welded to and integrated with each other. Thus, there can be manufactured a connector having the terminal 5 and electric wire accommodated therewithin.

FIG. 2 shows a conventional structure for manufacturing a multi-polar connector. In this connector, a plurality of groove portions 3 are formed in the first member 1 and a plurality of protruding portions 2 which oppose these groove portions 3 are formed in the second member 2. And, a terminal is accommodated in each groove 3, a covered electric wire is placed on the terminal, and thereafter the resulting laminate is pressed by the first member 1 and the second member 2. Then, ultrasonic vibration is applied thereto in an identical way as mentioned above to thereby provide a connector.

In the structure of FIG. 2 also, as in the case of FIGS. 1A and 1B, small concave portions are formed in the groove 3 of the first member 1 and small convex portions are formed on the protruding portion 7 of the second member 2.

FIG. 3 shows a state where the terminal 5 and the covered electric wire 6 are clamped between the first member 1 and second member 2 having the above-described structure. By being pressed by the protruding portion of the second member 2, the terminal 5 and the covered electric wire 6 are superposed one over the other and are bent at their portions corresponding to the convex portions and the concave portions 4. Reference symbols 5*a* and 6*a* designate bent portions thereof. By forming the bent portions 5*a* and 6*a* in the terminal 5 and covered electric wire 6 as mentioned above, it is possible to prevent these members from being drawn off.

However, in the conventional structure, there occurs the phenomenon that the terminal 5 is buried when ultrasonic vibration is applied. FIG. 4 illustrates this phenomenon and FIG. 5 is an enlarged cross section of a portion B of FIG. 4.

Due to the heat generated by application of ultrasonic vibration, the first member 1 and the second member 2 are softened. When in this state the second member 2 is pressed against the first member 1, this first member 1 with which the terminal 5 contacts is somewhat recessed or depressed by being pressed. For this reason, an end portion of the terminal 5 is embedded or buried in the first member 1 and thus is lowered in level from a horizontal line H shown in FIG. 5, with the result that the position of the terminal 5 as a whole is lowered more than the designed position. This embedment prominently occurs particularly at the groove portion of the first member locally pressed by the protruding portion 7 of the second member.

When the position of the terminal 5 becomes lowered from the designed position due to such embedment, interfitting or contacting of the terminal 5 with a terminal of a mating connector to which the terminal 5 is connected cannot be effected, raising the problem that electrical connection between the connectors becomes impossible.

SUMMARY OF THE INVENTION

The present invention has been achieved with such points in view.

It therefore is an object of the present invention to provide an electric wire connection structure in which even when heat is generated due to application of ultrasonic vibration the terminal can be maintained to be at its designed position without being embedded in.

To achieve the object, a first aspect of the invention provides an electric wire connection structure in which a terminal is accommodated in a groove portion formed in a first member made of resin; a covered electric wire is placed on this terminal; and by applying ultrasonic vibration while pressing the covered electric wire against the terminal by a second member made of resin and having a protruding portion closing the groove, a core wire of the covered electric wire and the terminal are connected and brought into electric conduction therebetween, the second member being made of resin having a heat resistance lower than the resin constituting a bottom wall portion of the groove portion.

According to the first aspect, the terminal having the covered electric wire placed thereon is accommodated in the groove portion of the first member and this terminal is clamped between the first member and the second member. And, in this state, the second member is pressed and simultaneously ultrasonic vibration is applied thereto. By this application of ultrasonic vibration, heat is generated whereby the first member 1 and the second member 2 are welded to each other.

This pressing performed by the second member acts on the bottom wall portion of the groove of the first member through the terminal. However, the second member is made of resin having a heat resistance lower than that of the bottom wall portion of the groove portion. As a result of this, the bottom wall portion of the groove portion is higher in heat resistance than the second member. Accordingly, although it may happen that the second member per se is recessed by the pressing performed by the second member, there is no possibility that the bottom wall portion of the groove portion will be recessed. Namely, it does not happen that the terminal will be embedded in the bottom wall portion of the groove, with the result that the height of the terminal can be maintained to be at a level identical as the level of the designed position of the terminal.

Accordingly, it does not happen that the terminal will be embedded in the bottom wall portion of the groove portion, with the result that the height of the terminal can be maintained to be at a level identical as the level of the designed position of the terminal.

A second aspect of the invention provides an electric wire connection structure wherein the second member has the protruding portion closing the groove portion and at least this protruding portion is made of resin having a heat resistance lower than the resin constituting the bottom wall portion of the groove portion.

According to the second aspect, the protruding portion of the second member is made of resin having a heat resistance lower than that of the resin constituting the bottom wall portion of the groove portion. As a result of this, the heat resistance of the bottom wall portion of the groove portion of the first member pressed by the protruding portion becomes higher than the heat resistance of this protruding portion, with the result that it is possible to prevent the terminal from being embedded as in the case of the above-mentioned first aspect. In this structure, the entire second member is not molded from resin having a lower heat resistance and only the protruding portion thereof alone is molded from resin having a lower heat resistance. Accordingly, the remaining portion of the second member can be made using identical quality of resin as that constituting the first member, whereby the first member and the second member have good affinity with each other and so the weldability thereof is enhanced.

Accordingly, it is possible to prevent the terminal from being embedded similarly.

BRIEF DESCRIPTION OF THE ACCOMPANYING DRAWINGS

The above and further objects and novel features of the present invention will more fully appear from the following description when the same is read in conjunction with the accompanying drawings, in which.

DETAILED DESCRIPTION OF THE PREFERRED EMBODIMENTS

Figure 1A:
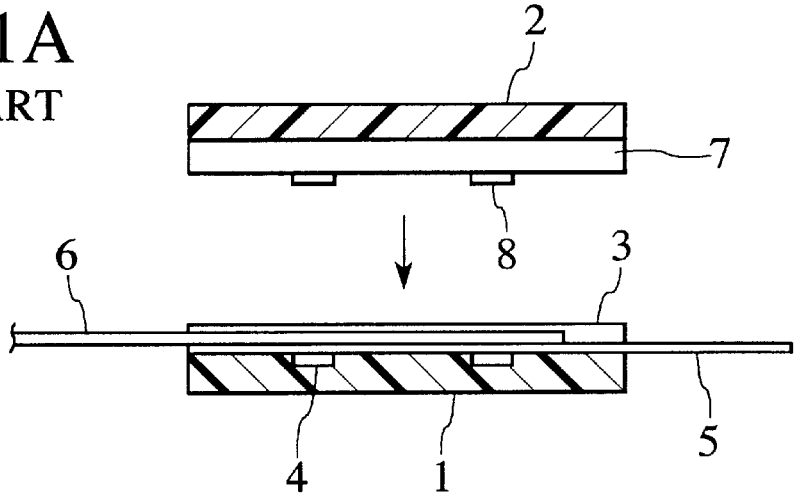
FIG. 1A PRIOR ART
FIG. 1A is a section of a conventional connection structure and FIG. 1B is a front view thereof.
Figure 1B:
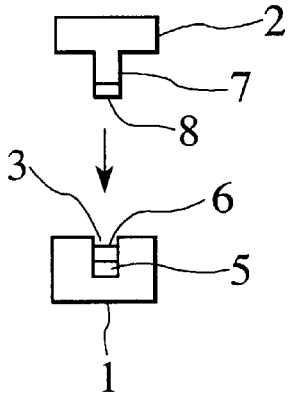
FIG. 1B PRIOR ART
Figure 2:
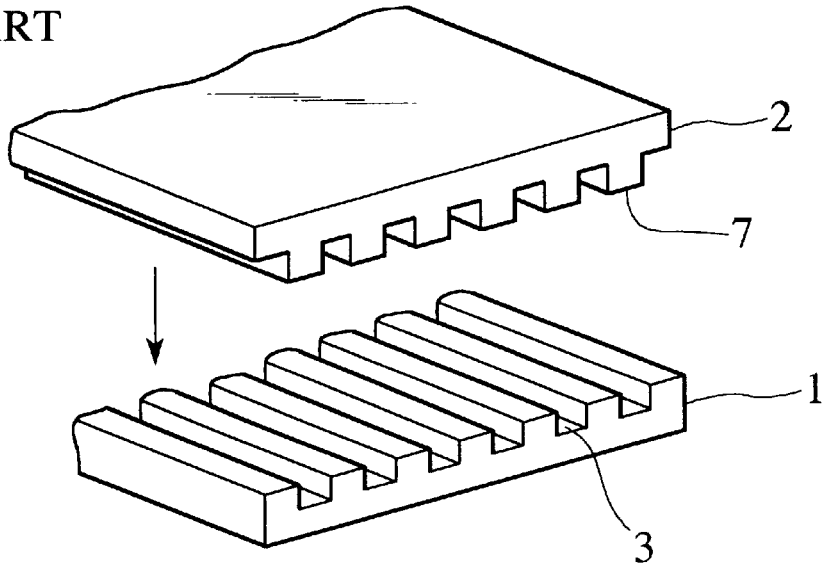
FIG. 2 PRIOR ART
FIG. 2 is an exploded perspective view of another conventional connection structure.
Figure 3:
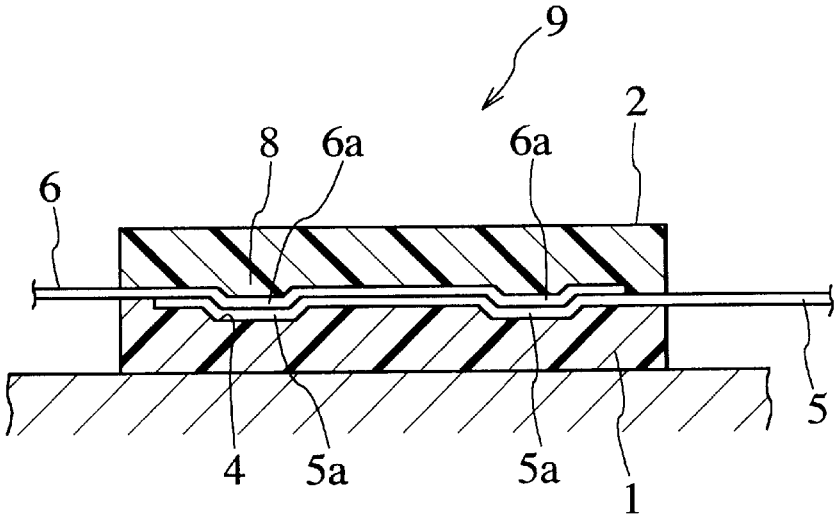
FIG. 3 PRIOR ART
FIG. 3 is a section of a conventional connection.
Figure 4:
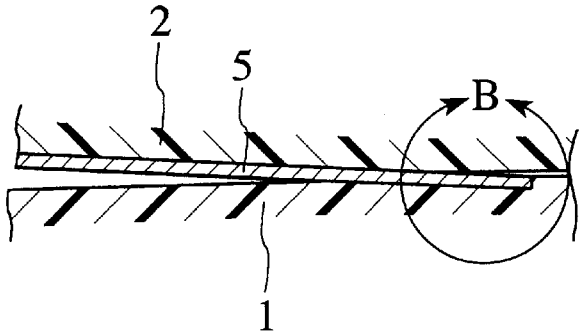
FIG. 4 PRIOR ART
FIG. 4 is a section showing an embedment of a terminal.
Figure 5:
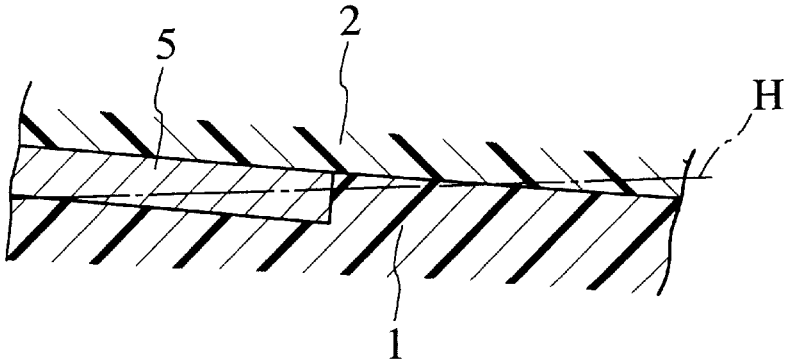
FIG. 5 PRIOR ART
FIG. 5 is an enlarged section of a portion B of FIG. 8.

The contents of U.S. Pat. No. 5,584,122 are incorporated herein by reference.

There will be detailed below the preferred embodiments of the present invention with reference to the accompanying drawings. Like members are designated by like reference characters.

Figure 6:
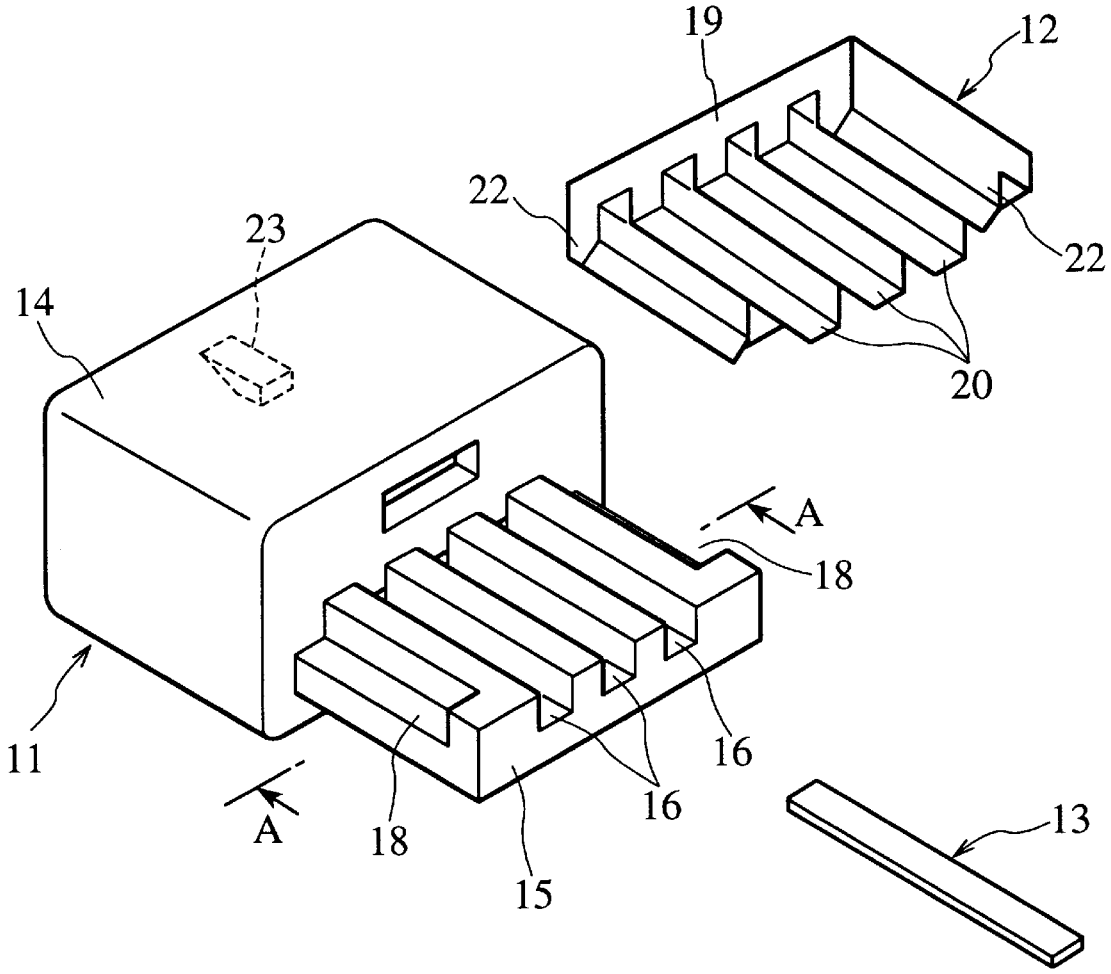
FIG. 6 is an exploded perspective view of an embodiment of the present invention.
Figure 7:
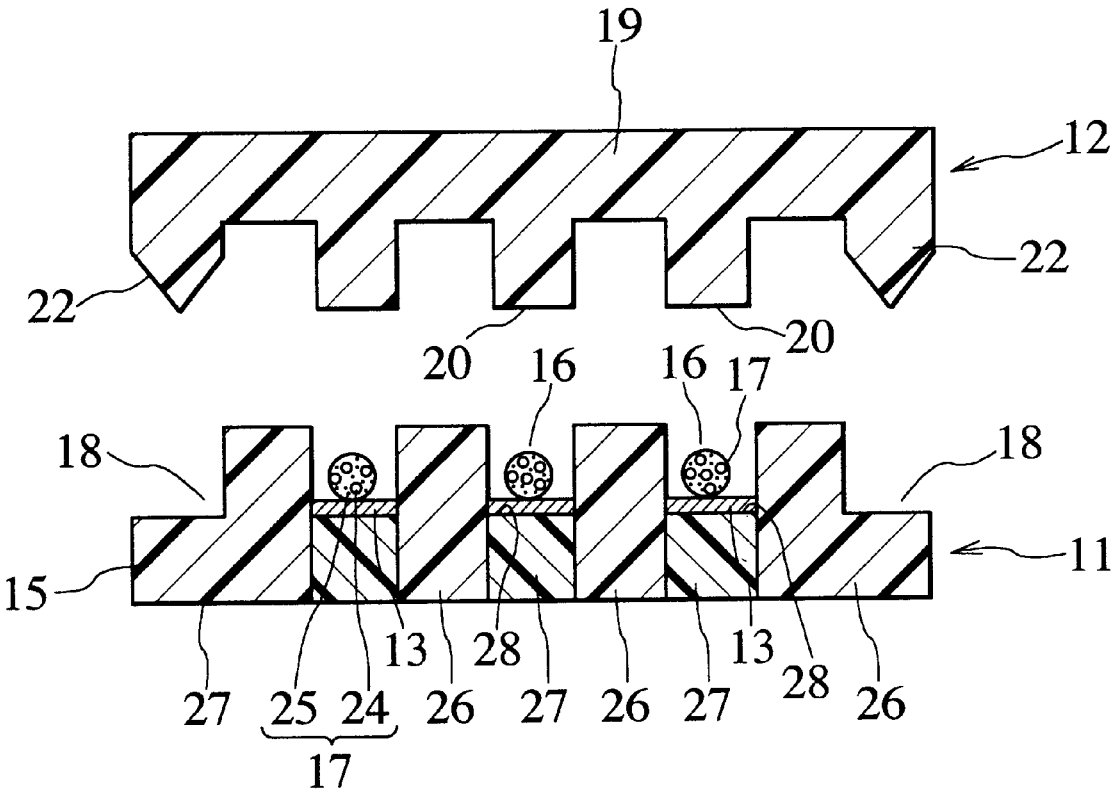
FIG. 7 is a section taken along a line A—A of FIG. 6 in an assembled state of the embodiment.

FIG. 6 is an exploded perspective view of an embodiment as a whole of the present invention and FIG. 7 is a section taken along a line A—A of FIG. 6, which section shows an assembled state of the embodiment. As shown in FIG. 6, the embodiment is equipped with a first member 11 made of resin, a second member 12 made of resin and a terminal 13 molded from conductive metal.

This embodiment is one wherein the present invention has been applied to a connector, and the first member 11 is a connector housing and the second member 12 is a cover member.

The first member 11 serving as a connector housing is equipped with a housing main body 4 connected to a mating connector (not shown) by interfitting therebetween and an electric wire retaining portion 15 continuously provided integrally on one side of the housing main body 14. It is to be noted that in order to engage the housing main body 14 with the mating connector the housing main body 14 is interiorly formed with a hook portion 23.

The electric wire retaining portion 15 has formed therein in parallel with each other a plurality of groove portions 16 each open at its upper zone and each of a rectangular cross section. In these groove portions 16 there are respectively accommodated the terminals, whereby covered electric wires 17 (see FIG. 7) and the terminals 13 are connected to each other. On both sides of the electric wire retaining portion 15 there are provided in parallel with the groove portions 13 recessed portions 18, respectively, at which the first member 11 and the second member 12 are welded to each other.

The second member 12 serving as a cover member has a flat plate-like cover main body 19 and a plurality of parallel protruding portions 20 formed on one surface of the cover main body 19. The protruding portions 20 are each formed into a rectangular cross section as in the case of the groove portion 16 of the first member 11 and are each fitted into the groove portion 16 to thereby close the groove portion 16.

Also, on both sides of the cover main body 19 there are formed abutment portions 22 parallel with the protruding portions, respectively. Each abutment portion 22 abuts against the recessed portion 18 of the first member 11 and is welded thereto, whereby the first member 11 and the second member 12 are integrated together. This abutment portion 22 is so arranged as to facilitate the welding by being formed so as to sharpen at its forward end.

The terminal 13 is formed in the shape of a flat plate and is inserted into the groove portion 16 of the first member 11.

This terminal 13 passes through the housing main body 14 and the passed end thereof is contacted with a contact portion with a terminal of a mating connector fitted into the housing main body 14 and electrically connected thereto.

The covered electric wire 17, as shown in FIG. 7, is constructed by having a plurality of core wires 24 thereof covered by an insulating covering 25. This covered electric wire 17 is served for being connected to the terminal 13 by being placed thereon.

Further, as shown in FIG. 7, the electric wire retaining portion 15 of the first member 11 is constituted by a main body portion 26 and a block portion 27. The level in position of the block portion 27 is lowered as compared with that of the main body portion 26 and, by clamping each block portion 27 by the main body portions 26, the groove portion 16 is formed. Accordingly, the main body 26 constitutes a side wall portion of the groove 16 and, on the other hand, an upper surface of the block portion 27 constitutes a bottom wall portion 28 of the groove portion 16.

In this embodiment, of the members each made of resin, only the block portion 27 alone is formed using a different kind of resin. Namely, although the main body portion 26 of the first member 11 and the second member are formed using identical kind of resin, the block portion 27 is made of resin which is different from the resin constituting each of them.

More specifically, the block portion 27 is formed using resin having a higher heat resistance while, on the other hand, the main body portion 26 of the first member and the second member 12 is formed using resin having a heat resistance lower than that constituting the block portion 27. For example, in a case where the block portion 27 is made of polyether imide (PEI), the main body portion 26 of the first member 11 and the second member 12 are each made of, for example, polybutylene terephthalate which is lower in resistance to heat. By using different kinds of resin in this way, the entire second member 12 is lower in heat resistance than the block portion 27 constituting the bottom wall portion 28 of the groove portion 16. It is to be noted that the first member 11 made of different resin can be formed by dichroic molding, post-molding interfitting or the like.

Next, the assembling of this embodiment will be explained with reference to FIG. 7.

The terminal 13 is inserted into each of the groove portion 16 of the first member 11 and a forward end portion thereof is passed through the housing main body 14. And, the covered electric wire 17 is placed on the terminal and the second member 12 is covered onto the electric wire retaining portion 15 of the first member 11. At this time, each protruding portion 20 is fitted into the groove portion 16, thereby pressing the second member 12.

With the electric wire retaining portion 15 and the cover main body 19 being kept pressurized by a horn (not shown) in a state where the above pressing is being maintained as is, ultrasonic vibration is applied. Heat is generated by this application of ultrasonic vibration and due to this heat the first member 11 and the second member 12 are welded together and integrated together. Also, due to the heat resulting from application of ultrasonic vibration, the insulating covering 25 of the covered electric wire 17 is molten whereby the core wires 24 are exposed. The thus-exposed core wires 25 are released from their bundled state and each of them contacts with the terminal 13, whereby the terminal 13 and the covered electric wire 17 are brought into electric conduction therebetween.

While the first member 11 and the second member 12 are heated by the above-mentioned ultrasonic vibration applied while the pressing is being performed, since the second member 12 whose protruding portion 20 presses the terminal 13 is molded using resin having a heat resistance lower than that of the resin constituting the block portion 27 of the groove portion 16 in which the terminal 13 is placed, this second member 12 is higher in degree of softening than the block portion 27. Namely, the block portion 27 is relatively low in degree of softening and therefore is not recessed even when depressed. For this reason, it does not happen that the terminal 13 is embedded in the block portion 27, and so the terminal 13 is fixed at a positional level as designed. As a result of this, the terminal 13 can contact excellently with the terminal of the mating connector, which enables the provision of a reliable connection.

Figure 8:
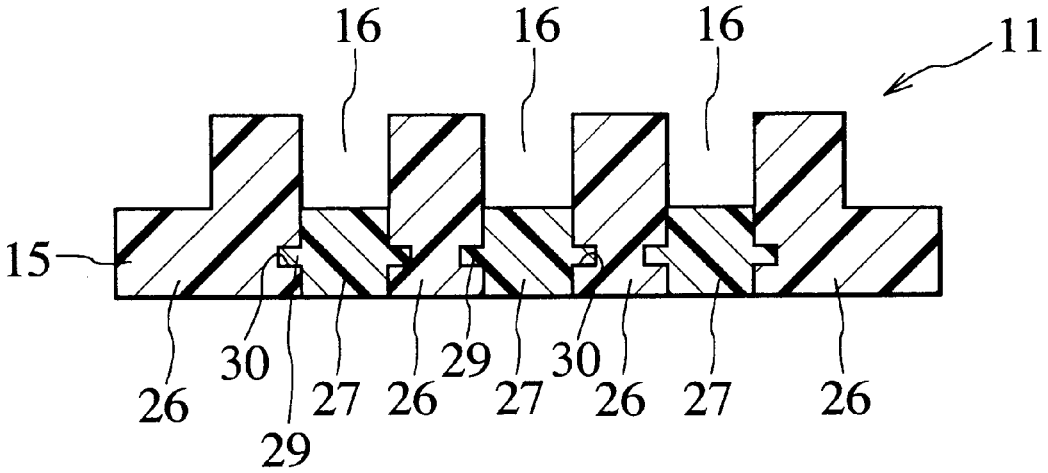
FIG. 8 is a section of a variation of the embodiment.

FIG. 8 shows a variation of this embodiment, in which the electric wire retaining portion and the first member 11 is constituted by the block portion 27 having a higher heat resistance and the main body portions 26 clamping this block portion 27 therebetween and each having a lower heat resistance. The block portion 27 is formed with engaging convex portions 29 on both sides thereof, which engaging convex portions 29 are fitted into engaging concave portions 30 formed in their opposing portions of the corresponding main body portions 26. As the bond between the block portion 27 and the main body portion 26 becomes firm by engagement of these engaging convex portions 29 and engaging concave portions 30, the strength against the pressing force becomes high, with the result that the recessing or deforming thereof can be reliably prevented.

Figure 9:
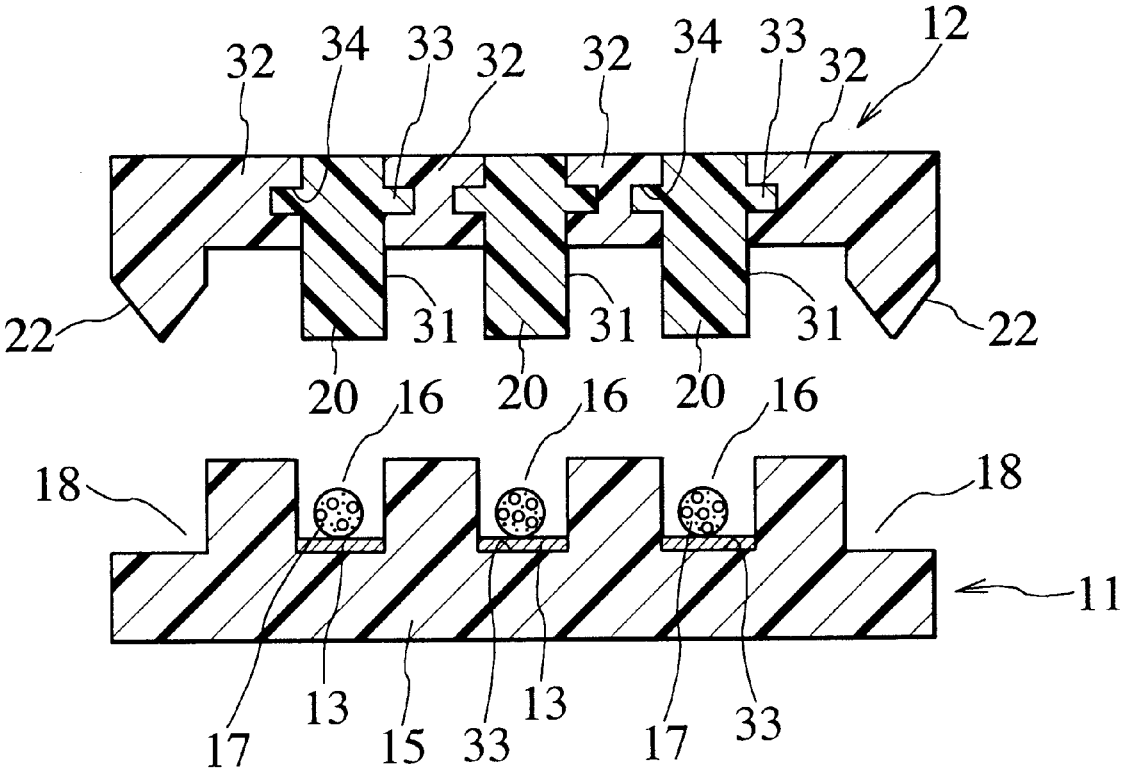
FIG. 9 is a section of another embodiment.

FIG. 9 shows another embodiment. In this embodiment, although an entire first member 11 is made of identical kind of resin, a second member 12 is made of different resin.

The second member 12 is constituted by two members, i.e., a vertically extending block portion 31 and a main body portion 32 so provided as to clamp this block portion 31. The length of the block portion 31 is larger than that of the main body portion 32, whereby portions protruding as compared with the main body portion 32 become protruding portions 20 closing groove portions 16 of the first member 11.

In this second member 12, the block portion 31 is made of resin having a heat resistance lower than that of the resin constituting the main body portion 32 and the first member 11. As a result of this, the protruding portion 20 of the second member 12 constituted by the block portion 31 is lower in heat resistance than a bottom wall portion 33 of the groove portion 16 of the first member 11 in which a terminal 13 is placed. Namely, the bottom wall portion 33 of the groove portion 16 has a heat resistance higher than that of the protruding portion 20 and so becomes low in degree of softening due to the heat generated by application of ultrasonic vibration. As a result, the recessing due to the pressing becomes none and so the terminal 13 can be fixed at a designed height.

While preferred embodiments of the present invention have been described using specific terms, such description is for illustrative purposes, and it is to be understood that changes and variations may be made without departing from the spirit or scope of the following claims.

What is claimed is:

1. An electric wire connection structure comprising:

a first member having a groove portion and made of resin;

a terminal accommodated in the groove portion;

a covered electric wire placed on the terminal; and a second member having a protruding portion positioned in the groove portion and made of resin, whereby by applying ultrasonic vibration while pressing the covered electric wire against the terminal by the protruding portion, a core wire of the covered electric wire and the terminal are brought into electric conduction therebetween, and wherein at least the protruding portion of the second member is made of resin having a heat resistance lower than the resin constituting a bottom wall portion of the groove portion.

2. An electric wire connection structure according to claim 1, wherein the entire second member is made of resin having a heat resistance lower than the resin constituting the bottom wall portion of the groove portion.

* * * * *